US008707653B2

(12) United States Patent
Calleja

(10) Patent No.: US 8,707,653 B2
(45) Date of Patent: Apr. 29, 2014

(54) MODULAR TRUSS SYSTEM WITH SIX-WAY CONNECTOR BOXES

(76) Inventor: Michael J. Calleja, Brisbane, CA (US)

( * ) Notice: Subject to any disclaimer, the term of this patent is extended or adjusted under 35 U.S.C. 154(b) by 148 days.

(21) Appl. No.: 13/135,248

(22) Filed: Jun. 29, 2011

(65) Prior Publication Data

US 2012/0000874 A1 Jan. 5, 2012

Related U.S. Application Data

(60) Provisional application No. 61/398,857, filed on Jul. 1, 2010.

(51) Int. Cl.

| | |
|---|---|
| ***E04C 3/04*** | (2006.01) |
| ***E04B 1/19*** | (2006.01) |
| ***E04B 1/24*** | (2006.01) |
| ***E04C 3/08*** | (2006.01) |

(52) U.S. Cl.

CPC ..... *E04B 1/1912* (2013.01); *E04B 1/2403* (2013.01); *E04C 3/04* (2013.01); *E04C 3/08* (2013.01); *E04B 2001/2406* (2013.01); *E04B 2001/2472* (2013.01); *E04C 2003/0413* (2013.01)

USPC ..... 52/655.1; 52/650.1; 52/848; 403/171; 29/897.3; 29/897.31; 29/897.312; 29/525.11

(58) Field of Classification Search

CPC ..... E04B 1/24; E04B 1/19; E04B 1/1903; E04B 1/1912; E04B 1/2403; E04B 2001/2406; E04B 2001/2472; E04C 3/04; E04C 3/065; E04C 3/08; E04C 2003/04; E04C 2003/0417; E04C 2003/0413

USPC ..... 52/648.1, 655.1, 645, 646, 650.1, 843, 52/845, 848; 403/170, 176, 171, 172, 205, 403/217; 446/126; 29/897.3, 897.31, 29/897.312, 525.11, 525.02

See application file for complete search history.

(56) References Cited

U.S. PATENT DOCUMENTS

| | | | | | |
|---|---|---|---|---|---|
| 1,400,066 | A | * | 12/1921 | Huck | 446/123 |
| 3,067,609 | A | * | 12/1962 | Bailey et al. | 73/800 |
| 3,264,021 | A | * | 8/1966 | Artman | 403/3 |
| 3,674,289 | A | * | 7/1972 | Geraci | 403/189 |
| 3,882,650 | A | * | 5/1975 | Gugliotta | 52/223.12 |
| 4,012,153 | A | * | 3/1977 | Pidgeon et al. | 403/170 |
| 4,027,449 | A | * | 6/1977 | Alcalde Cilveti | 52/655.2 |
| 4,082,470 | A | * | 4/1978 | Alberts | 403/172 |
| 4,161,088 | A | * | 7/1979 | Gugliotta et al. | 52/223.12 |
| 4,231,198 | A | * | 11/1980 | Augier et al. | 52/91.2 |

(Continued)

OTHER PUBLICATIONS

Monster Truss 6" Black Truss Junction Block, (c) 2010, webpage on the Internet, http://monstertruss.com/pages/sq6ujb.html.

*Primary Examiner* — Brent W Herring
(74) *Attorney, Agent, or Firm* — Robert Charles Hill

(57) ABSTRACT

A modular truss system includes six-way box connectors to which truss beams can be bolted and pinned together in a wide variety of configurations and to any or all of the six identical faces. Each box connector face and each truss beam endplate is fitted with matching center holes for bolts and spring pin arrangements on the peripheral corners. These make aligning and attaching the truss beams and box connectors to one another a quick and simple job that does not require any tools. The truss beam endplates have one or more spring pins and a center hole that matches the ones in each of the six faces of the box connectors.

9 Claims, 6 Drawing Sheets

(56) References Cited

U.S. PATENT DOCUMENTS

| | | | | | |
|---|---|---|---|---|---|
| 4,780,018 | A | * | 10/1988 | Godden | 403/173 |
| 4,922,669 | A | * | 5/1990 | De Pas et al. | 52/646 |
| 5,205,101 | A | * | 4/1993 | Swan et al. | 52/650.1 |
| 5,214,899 | A | * | 6/1993 | Beeche et al. | 52/648.1 |
| 5,305,571 | A | * | 4/1994 | Trevino | 52/653.2 |
| 5,580,181 | A | * | 12/1996 | Nomura | 403/170 |
| 5,826,384 | A | * | 10/1998 | O'Neill | 52/223.9 |
| 5,964,068 | A | | 10/1999 | O'Neill | |
| 6,792,732 | B2 | * | 9/2004 | Strassle et al. | 52/655.1 |
| 6,854,238 | B2 | * | 2/2005 | Boots | 52/655.1 |
| 2009/0175678 | A1 | * | 7/2009 | Nientiedt et al. | 403/171 |
| 2011/0194892 | A1 | * | 8/2011 | Huang | 403/296 |
| 2012/0301215 | A1 | * | 11/2012 | Huang | 403/176 |

* cited by examiner

MODULAR TRUSS SYSTEM WITH SIX-WAY CONNECTOR BOXES

RELATED APPLICATIONS

This non-provisional application claims priority from U.S. Provisional Patent Application, titled Modular Truss System, Ser. No. 61/398,857, filed Jul. 1, 2010.

BACKGROUND OF THE INVENTION

1. Field of the Invention

The present invention relates to truss systems typically used in homes, offices, retail space, stages and trade shows. In particular, the present invention relates to truss systems that are built up from six-way box connectors.

2. Description of Related Art

Trusses are widely used to support overhead lighting units powered by electrical power cords dressed along the truss raceways. Truss systems for stages and tradeshow floors are available in I-beam, triangle, and square truss sections made from aluminum or steel. Steel trusses are strong enough to permit 40-foot spans, and aluminum trusses have the advantage that they can be made from extruded pieces. Extrusions allow the possibility of including power tracks inside for track lighting heads.

Trussing typically comes in ten-foot sections, and can be interconnected with 2, 3, 4, 5, and 6-way corners. Conventional interconnections at the ends include the tube-in-socket kind, and those that butt and bolt together at the truss end plates.

Many trusses erected to support lighting, frames, screens, and other devices are temporary and used over and over again at many different concert and tradeshow locations. It is therefore important that they assembly quickly, easily, and securely. They also need to be light and portable, and rugged enough to keep looking good and resist breaking and damage. Truss systems that can snap together and require no tools for assembly and disassembly are especially desirable.

SUMMARY OF THE INVENTION

Briefly, a modular truss system embodiment of the present invention includes six-way box connectors to which truss beams can be bolted and pinned in a wide variety of configurations to any of the six identical faces. Each box connector face and each truss beam end is fitted with matching center holes for bolts and spring pin arrangements on the peripheral corners. These make aligning and attaching the truss beams and box connectors to one another a quick and simple job and does not require any tools. The ends of the trusses have end plates with one or more spring pins and a center hole that matches the ones in each of the six faces of the box connectors.

The above and still further objects, features, and advantages of the present invention will become apparent upon consideration of the following detailed description of specific embodiments thereof, especially when taken in conjunction with the accompanying drawings.

DETAILED DESCRIPTION OF THE INVENTION

Figure 1:
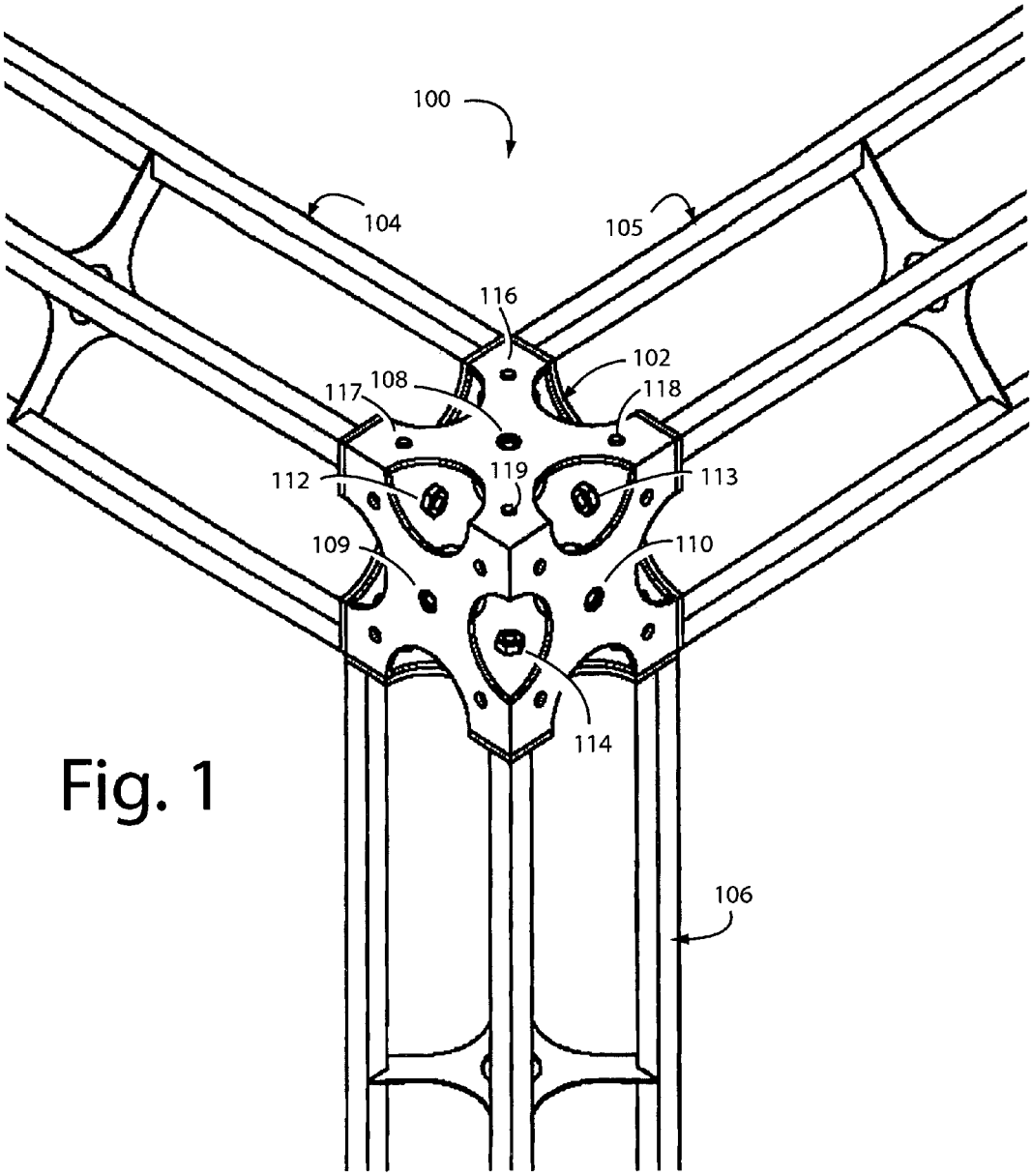
FIG. 1 is a perspective view diagram of three truss beams connected to orthogonal faces of a six-way box connector in a modular truss system embodiment of the present invention.

FIG. 1 represents a modular truss system embodiment of the present invention, and is referred to herein by the general reference numeral 100. Assembling modular truss systems 100 begin with six-way box connectors like box connector 102. In FIG. 1, such forms a 90-degree square corner when three truss beams 104-106 are attached. Each of the six faces of box connector 102 are identical and provided with five holes. The center hole, e.g., 108-110, is provided with a weld-nut or cage nut behind, e.g., 112-114. A knurled bolt (not seen here) is used to secure each of the three truss beams 104-106 to box connector 102 without needing a wrench or any other tool.

The four holes, e.g., 116-119, at the corners accommodate a spring pin (not seen here) that protrudes from a matching position in the ends of the three truss beams 104-106 attached. The central location of the center holes allows the beam trusses to be rotated on the knurled bolts until the corresponding spring pins find a matching corner hole and drops in and locks.

Figure 2:
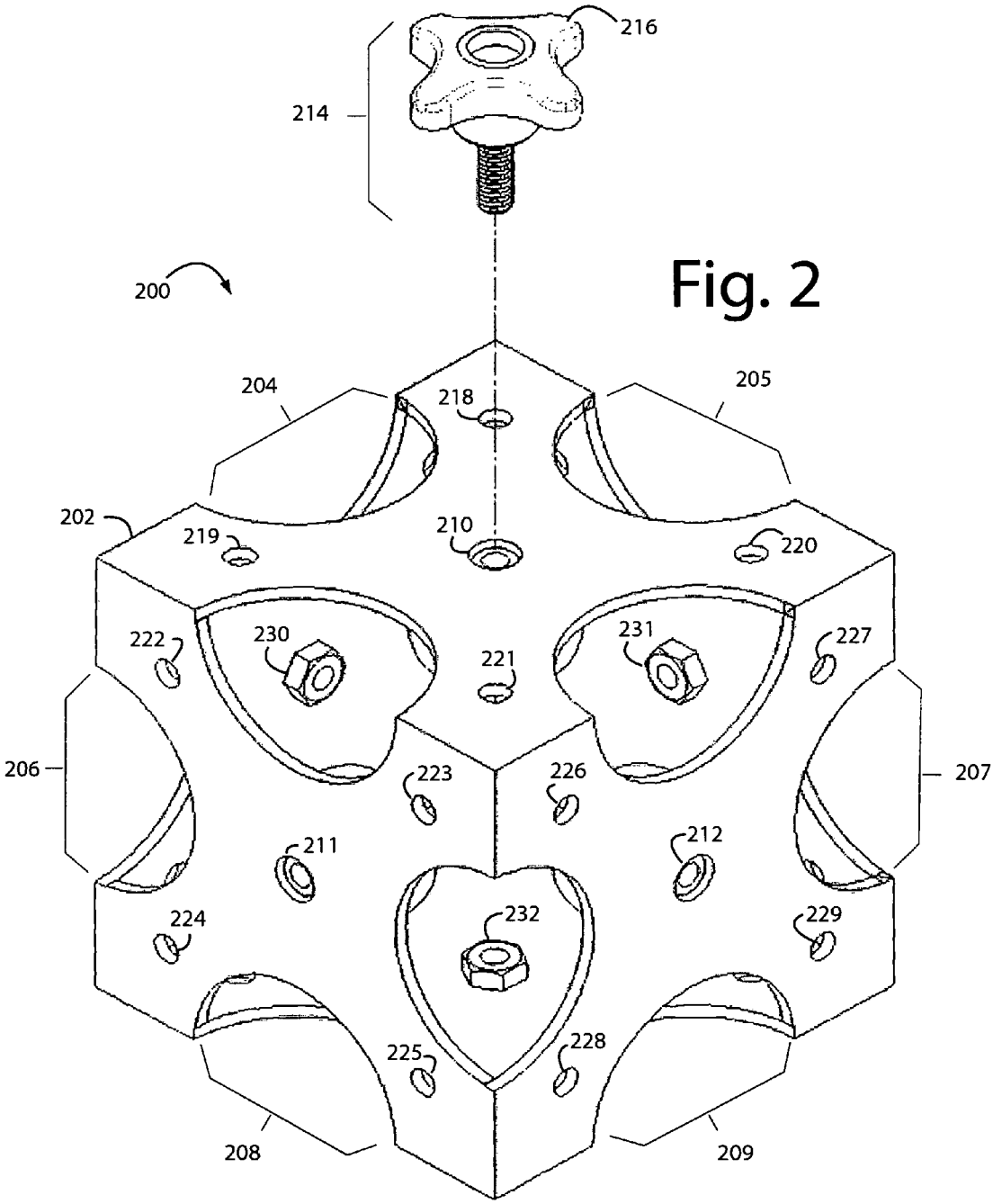
FIG. 2 is a perspective view diagram of a six-way box connector useful in the modular truss system of FIG. 1.

FIG. 2 provides greater detail of a six-way box connector 200, in an embodiment of the present invention. The basic shape is a hollow cube 202 made of metal or plastic. The materials are chosen according to the kinds of loads and stresses that will be applied. Twelve access cutouts are provided, e.g., 204-209, for passing through electrical wiring or the like amongst the attached truss beams. Each of the six faces has a center hole, e.g., 210-212, for a knurled bolt 214 with a knob 216, and four equally sized corner holes, e.g., 218-229, to receive one to four spring pins (shown in FIG. 3). A machine nut, e.g., 230-232, is disposed behind each of the center holes on the six faces. These can be weld-on nuts, caged nuts, blind nuts, rivet nuts, threaded inserts, or other captive nut.

The distance between the center hole and each of the four corner holes on each face is the same. During assembly this allows an installer to rotate a truss beam that is loosely held on to a box connector with knurled bolt 214 so a spring pin on the truss beam end plate can find and lock into any of the four corner holes. The knurled bolt 214 is then fully tightened by the installer to secure the connection.

Figure 3:
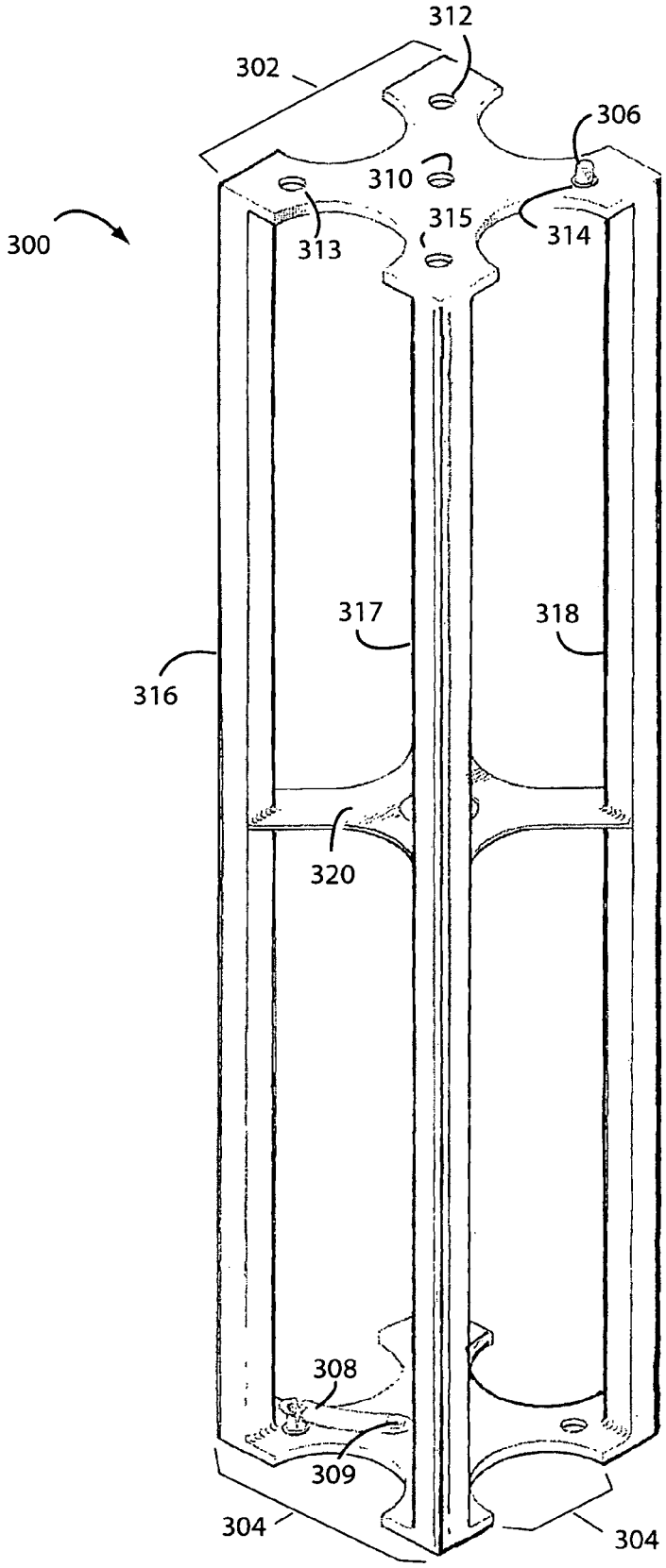
FIG. 3 is a perspective view diagram of a truss beam useful in the modular truss system of FIG. 1.

FIG. 3 represents a truss beam 300 with end plates 302 and 304 that match and can mate with any of the six faces of a box connector like those of FIGS. 1-2. A spring pin 306 is disposed in end plate 302, as is a spring pin 308 in end plate 304. The spring plate is attached to the end plate by rivet 309 or other means. Each end plate has a center hole, e.g., 310, and four corner holes, e.g., 312-315. These match corresponding holes in the box connectors of FIGS. 1-2.

Four rails, e.g., 316-318, span between end plates 302 and 304. When the lengths of truss beams 300 exceed two feet, it is usual to include webbing or one or more gusset spiders 320, about every two feet maximum. Truss beams 300 are typically provided in standard lengths of two, four, six, eight, ten, and twelve feet.

Figure 4:
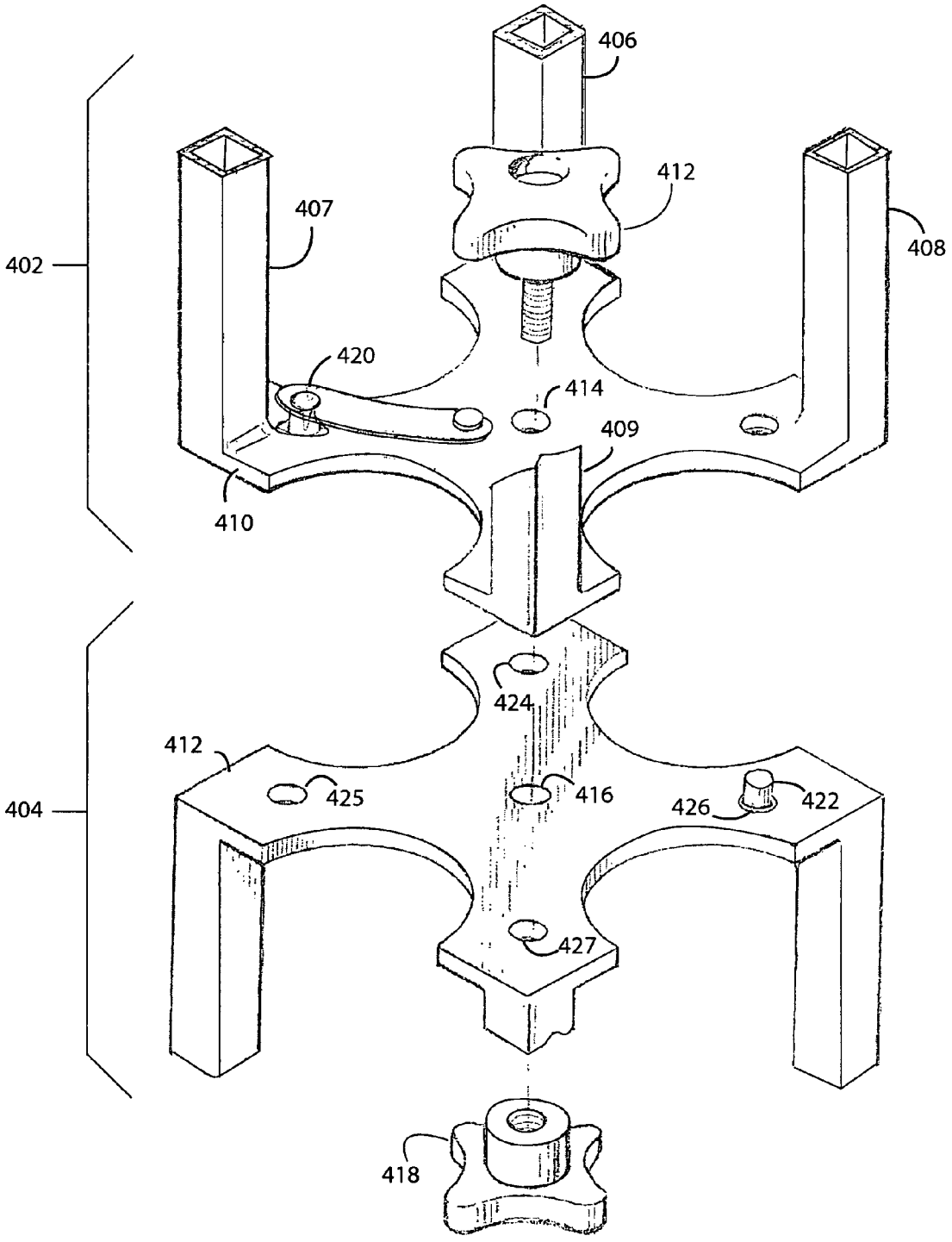
FIG. 4 is a perspective view diagram showing how the endplates of two truss beams can be joined in a modular truss system like that of FIG. 1.

FIG. 4 provides further details for the modular truss system illustrated thus far in FIGS. 1-3. Two truss beams can be joined at their respective ends 402 and 404 to one another in about the same manner as joining a truss beam to a six-way connector box. Truss beam end 402 has four rails 406-409 that terminate in an end plate 410. A knurled bolt 412 is passed through a center hole 414 in end plate 410 and a matching center hole 416 in end plate 412. A knurled nut 418 fastens onto the knurled bolt 412 to secure the two truss beam ends 402 and 404 together after a spring pin locks in to an adjoining truss beam end.

Each truss beam end 402 and 404 includes a spring pin 420 and 422. In FIG. 4 they are aligned 180-degrees apart from one another, but they also could be aligned 90-degrees and 270-degrees apart because there are four corner holes to accommodate them on each end plate 410 and 412. All four corner holes 424-427 can be seen for end plate 412 in FIG. 4.

Figure 5:
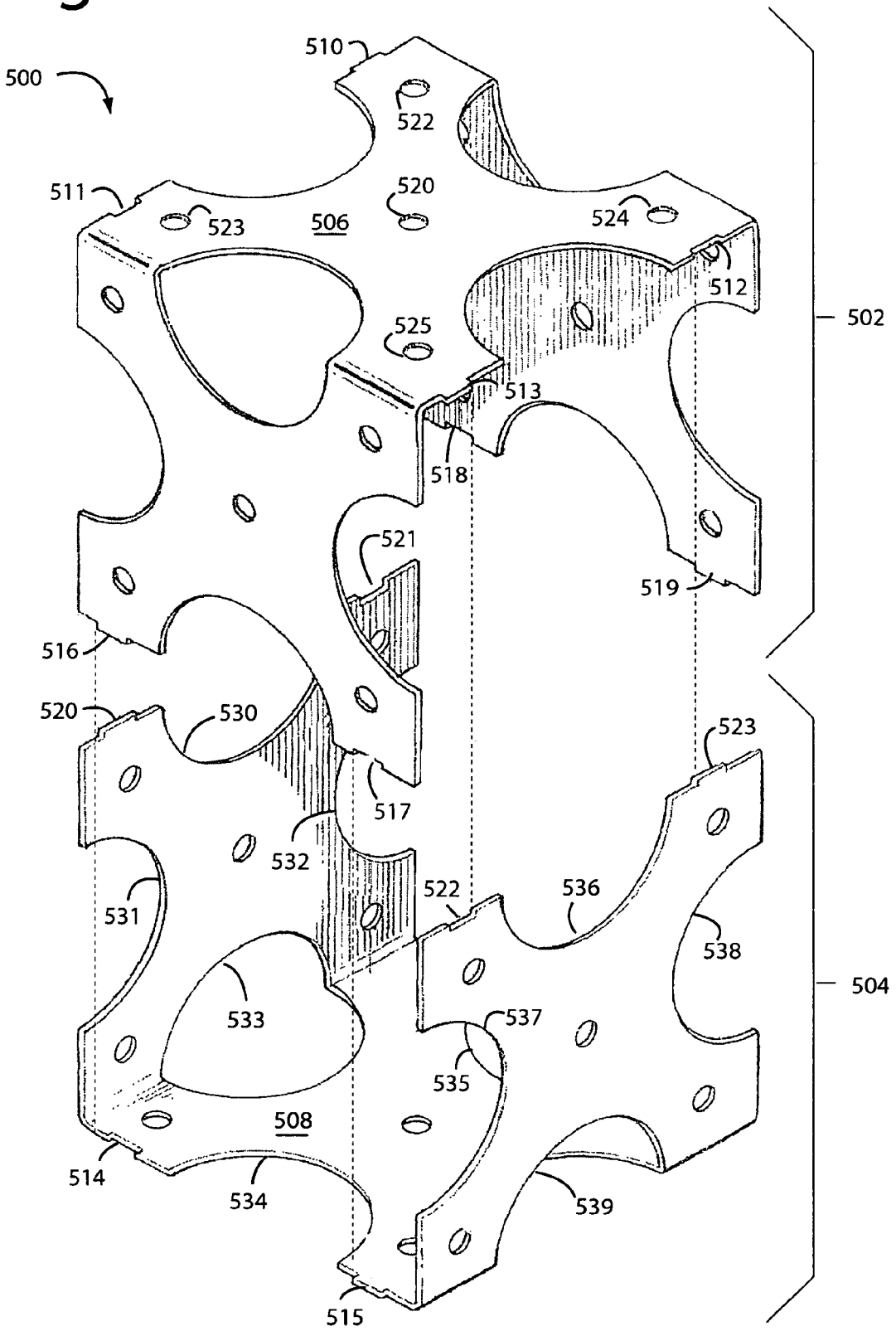
FIG. 5 is a perspective view diagram showing how a six-way box connector useful in the modular truss system of FIG. 1 can be made from two identical sheetmetal stampings.

FIG. 5 represents a practical way to manufacture a six-way connector box in an embodiment of the present invention referred to herein by the general reference numeral 500. Connector box 500 comprises two identical sheetmetal stampings 502 and 504 that are folded and then welded together at their endplates 506 and 508 by tabs 510-513. Only two such tabs 514-515 on endplate 508 can be seen in FIG. 5. The distal ends of each stamping 502 and 504 are respectively provided with matching tabs 516-519, and 520-523, to complete the welding.

All six faces of the cube thus formed are provided, e.g., with a center hole 520 and four equally spaced and equally set corner holes 522-525. These are equivalent to center hole 108 and corner holes 116-119 in FIG. 1; center hole 210-212 and corner holes 218-229 in FIG. 2; center hole 310 and corner holes 312-315 in FIG. 3; and, center hole 416 and corner holes 424-427 in FIG. 4. A weld-nut is typically provided behind each center hole 520.

Each sheetmetal stamping 502 and 504 is provided with nine access cutouts, e.g., 530-539. Access cutouts 533 and 539 are full ovals while the rest are half ovals. These allow stage wiring, for example, to be passed through between truss beams joined by connector box 500.

Figure 6:
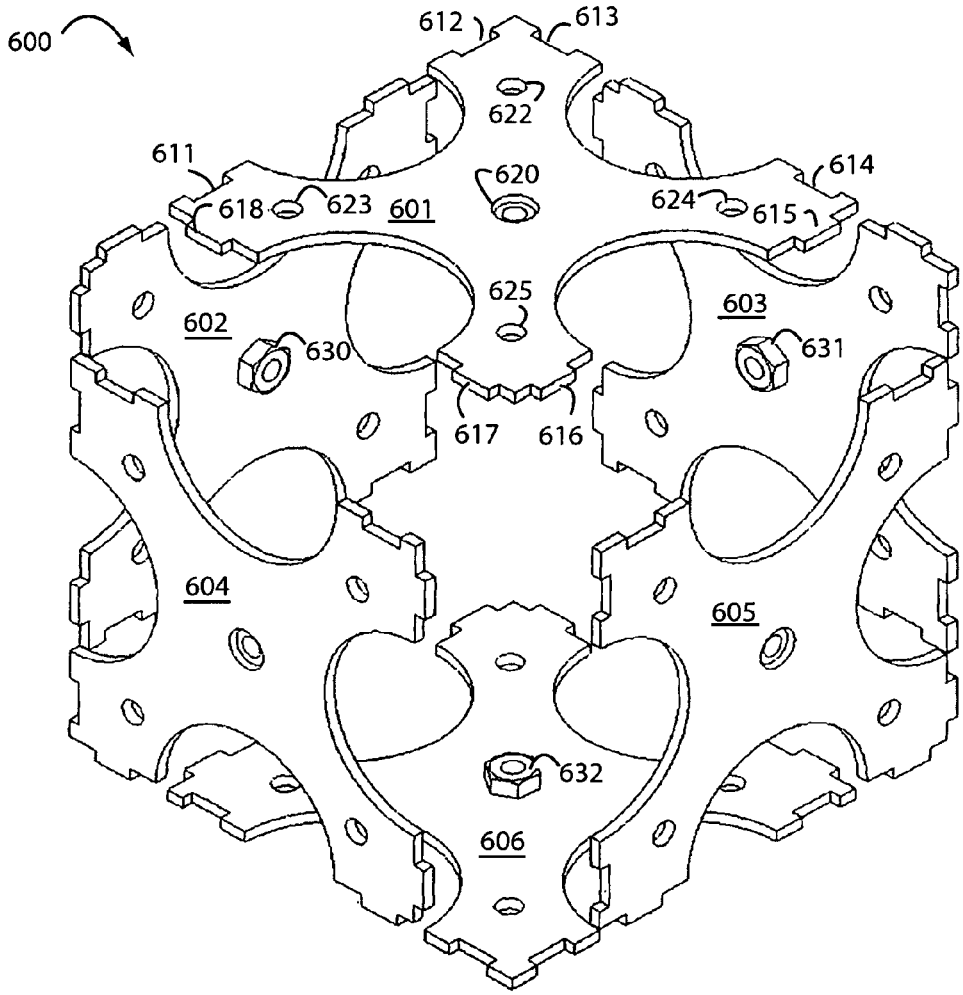
FIG. 6 is a perspective view diagram showing how a six-way box connector useful in the modular truss system of FIG. 1 can be made from six individual sheetmetal stampings.

FIG. 6 represents another practical way to manufacture a six-way connector box in an embodiment of the present invention referred to herein by the general reference numeral 600. Connector box 600 comprises six identical sheetmetal stampings, e.g., endplates 601-606 that are welded together at their four edges by eight interlocking tabs, e.g., tabs 611-618 on endplate 601.

All six faces of the cube formed are further provided, e.g., with a center hole 620 and four equally spaced and equally set corner holes 622-625. These are equivalent to center hole 108 and corner holes 116-119 in FIG. 1; center hole 210-212 and corner holes 218-229 in FIG. 2; center hole 310 and corner holes 312-315 in FIG. 3; and, center hole 416 and corner holes 424-427 in FIG. 4. A weld-nut, e.g., 630-632, is typically provided behind each center hole 620.

Embodiments of the present invention are not limited to the six-face box connectors described herein. Three, four, and five faces are also possible, as well as faces set at other than 90-degree orthogonal planes. Each face is nevertheless configured to mate with and be fastened to an end plate of a truss beam using a central bolt and spring pins and holes set at regular intervals around the periphery of the faces and the truss beam end plates.

Although particular embodiments of the present invention have been described and illustrated, such was not intended to limit the invention. Modifications and changes will no doubt become apparent to those skilled in the art, and it was intended that the invention only be limited by the scope of the appended claims.

The invention claimed is:

1. A truss system, comprising:

at least one six-faced box connector wherein each face is configured to mate with and be fastened to an end plate of a truss beam;

a central hole disposed in the middle of each face of the box connector that provides a way to fasten the box connector to a corresponding truss beam; and a plurality of corner holes disposed in a pattern around the central hole on each face of the box connector that provides a way to lock the box connector to said corresponding truss beam;

wherein the six-faced box connector is in the general shape of a hollow cube and all of its faces are identical;

a nut disposed behind each of the central holes;

at least two of the truss beam, each with a plurality of the end plate configured to mate with any one of the faces of the box connector and able to be secured with a bolt; and the bolt, separate from the six-faced box connector, configured to be passed through any one of the end plates of the truss beams and screwed into any one of the nuts to secure the respective truss beam to the six-faced box connector.

2. The truss system of claim 1, further comprising:

access cutouts provided between the corners of the six-faced box connector that allow wiring to be passed through and between any attached truss beam.

3. The truss system of claim 1, further comprising:

at least two metal stampings which are joined together to form a frame for the six-faced box connector.

4. The truss system of claim 1, further comprising:

a spring pin disposed in at least one of the end plates of the truss beams and configured to engage one of the corner holes disposed around a central hole in any face of the box connector.

5. A truss system, comprising:

at least one six-faced box connector wherein each face is configured to mate with and be fastened to an end plate of a truss beam, the box connector in the general shape of a hollow cube with all of its faces being identical;

a central hole disposed in the middle of each face of the box connector that provides a way to fasten the box connector to the truss beam;

a plurality of corner holes disposed in a pattern around the central hole on each face of the box connector that provides a way to lock the box connector to said truss beams;

a nut disposed behind each of the central holes;

at least one bolt separate from the six-faced box connector and configured to be passed through the end plate of the truss beam and screwed into the nut to secure the truss beam to the six-faced box connector;

access cutouts provided between the corners of the six-faced box connector that allow wiring to be passed through and between any attached truss beams;

at least two of the truss beam, each with a plurality of the end plate configured to mate with any of the faces of the box connector and that can be secured with corresponding ones of the bolts; and a spring pin disposed in the end plates of the truss beams and configured to engage one of the corner holes disposed around the central hole in any face of the box connector.

6. The truss system of claim 5, further comprising:

at least two metal stampings which are joined together to form a frame for the six-faced box connector

7. A truss system, comprising:

at least two truss beams each with end plates, and configured to mate together with the other truss beam;

a central hole disposed in the middle of each face of the end plates that provides a way to fasten one of the truss beams to another of the truss beams;

a plurality of corner holes disposed in a pattern around the central hole on each face of the end plates that provides a way to lock corresponding truss beams together;

a spring pin disposed in each of the end plates of the truss beams and configured to engage one of the corner holes disposed around said central hole;

a nut for positioning behind one of the central holes; and at least one bolt configured to be passed through one of the end plates of the truss beams and screwed into the nut to secure the truss beams together.

8. The truss system of claim 7, further comprising:

access cutouts provided between the corners of the end plates that allow wiring to be passed through and between any attached truss beams.

9. A method of attaching an end plate of a truss beam to a face plate of a box connector, comprising:

wherein the box connector has six faces each having the face plate, each face configured to mate and be fastened to the end plate of the truss beam, and the box connector is in the general shape of a hollow cube and all of its faces are identical;

a nut disposed behind each of the center holes;

providing each face plate with a center hole and a plurality of corner holes;

providing the end plate with a matching center hole and matching corner holes;

providing a spring pin in at least one corner hole of said end plate;

inserting a bolt into the matching center holes of said face plate and end plate;

rotating the end plate until said spring pin finds and locks into one of the corner holes of said face plate; and tightening said bolt to secure the attachment.

* * * * *